US006136706A

United States Patent [19]

Jabotinski et al.

[11] Patent Number: 6,136,706

[45] Date of Patent: Oct. 24, 2000

[54] PROCESS FOR MAKING TITANIUM

[75] Inventors: Vadim J. Jabotinski; Francis H. Froes, both of Moscow, Id.

[73] Assignee: Idaho Research Foundation, Moscow, Id.

[21] Appl. No.: 09/362,915

[22] Filed: Jul. 27, 1999

Related U.S. Application Data

[60] Provisional application No. 60/094,369, Jul. 27, 1998.

[51] Int. Cl.[7] ..... B22F 1/00

[52] U.S. Cl. ..... 438/683; 438/584; 438/679; 257/761

[58] Field of Search ..... 438/584, 679, 438/683; 257/761

[56] References Cited

U.S. PATENT DOCUMENTS 5,728,195 3/1998 Eastman et al. ..... 75/351

*Primary Examiner*—Chandra Chaudhari
*Assistant Examiner*—Lisa Kilday
*Attorney, Agent, or Firm*—Ormiston & McKinney PLLC

[57] ABSTRACT

A process for producing titanium that includes forming gaseous titanium and then transforming the gaseous titanium into solid titanium through condensation. The titanium gas is formed by vaporizing titania with an electron beam in the presence of carbon. The gas-containing vapor is cooled to form a titanium liquid or solid.

22 Claims, 10 Drawing Sheets

PROCESS FOR MAKING TITANIUM

CROSS REFERENCE TO RELATED APPLICATIONS

This application claims subject matter disclosed in the co-pending provisional application Ser. No. 60/094,369 filed Jul. 27, 1998, which is incorporated herein in its entirety.

FIELD OF THE INVENTION

The invention relates to the production of titanium through the direct reduction of titania containing raw materials with carbon by subjecting the titania containing and carbon components to intense and rapid heating with an electron beam.

BACKGROUND

Presently, titanium is produced commercially by converting titania to titanium chloride and reducing the titanium chloride through the Kroll or Hunter processes. The cost of production by these processes is much higher than is desirable for many commercial uses of titanium. The production of titanium by reducing titanium chloride is a multi-step process. First, titania is converted to titanium chloride in the presence of carbon at about 1,200° K. Then, the titanium chloride is reduced by magnesium or sodium at temperatures in the range of 1,000° K. to 1,300° K. The titanium metal is separated from the magnesium chloride or sodium chloride and a number of other impurities in the reaction products by leaching or vacuum distilling to get sponge titanium.

The cost of producing titanium sponge using conventional processes is high because of the large consumption of energy and the expensive starting materials. These conventional processes will consume, for example, about 40 kilowatt-hours for every kilogram of titanium produced. The sponge titanium can contain up to 1% percent impurities that may include contamination from the steel reactor walls, impurities from the titanium chloride, residual gases in the reactor and magnesium or sodium residues. In addition, these processes are slow and the titanium chloride, magnesium and sodium are hazardous and expensive starting materials.

SUMMARY

The present invention is directed to a new process for producing titanium that helps alleviate some of the problems associated with the conventional multi-stage production process. The invented process consists of forming gaseous titanium and then transforming the gaseous titanium into liquid or solid titanium by, for example, condensing out a titanium liquid or solid. "Solid" titanium means titanium in its solid phase, as contrasted with liquid or gaseous titanium. Solid titanium includes titanium powder and solid titanium metal.

In one embodiment of the invention, the titanium gas is formed by vaporizing titania with an electron beam in the presence of carbon. This reaction is illustrated in Equation No. 1.

$$TiO_2+2C \rightarrow Ti(g)+2CO \quad (1)$$

The titanium gas and carbon monoxide are cooled to condense out solid titanium.

In a second embodiment of the invention, methane is used as the source of the carbon reducing agent. In this second embodiment, methane is introduced in to the reaction chamber as the titania is vaporized with the electron beam. The reaction, which is illustrated in Equation No. 2, produces gaseous titanium, carbon monoxide and hydrogen.

$$TiO_2+2CH_4 \rightarrow Ti(g)+2CO+(2.5-0.5)H_2+(3-7)H \quad (2)$$

The reaction products are cooled to condense out solid titanium.

Although the reduction of titania with carbon has been mentioned in scientific literature, so far as the applicants are aware, there is no experimental evidence of the direct reduction of titania to titanium with carbon. Ulmann's Encyclopedia of Industrial Chemistry, by W. Gerhartz (Germany 1994), reports in Vol. A27 at page 102 that the carbon reduction of titanium dioxide is possible above 6,000° C. This statement has little significance because none of the relevant compounds will exist above 6,000° C.

It has been discovered that the concentrated electron beam, or another suitable rapid high intensity heat source, provides the requisite heating intensity and temperature to reduce titania to titanium. The rapid high intensity heating provided by the electron beam has several advantages. Firstly, the starting mixture can be heated directly. Secondly, the heat treatment can be conducted under either a partial vacuum or at high pressure in the presence of any vapors which might be present. Thirdly, the electron beam as a heat source is capable of comparatively precise control and is highly intensive. These attributes permit the maintenance of the required heating conditions. The electron beam is also highly efficient. Power losses as the beam passes through vaporized products and reflecting effects are practically negligible. Further, the electron beam seems to catalyze the chemical reactions.

DETAILED DESCRIPTION

Reduction of Titania with Carbon

Figure 1:
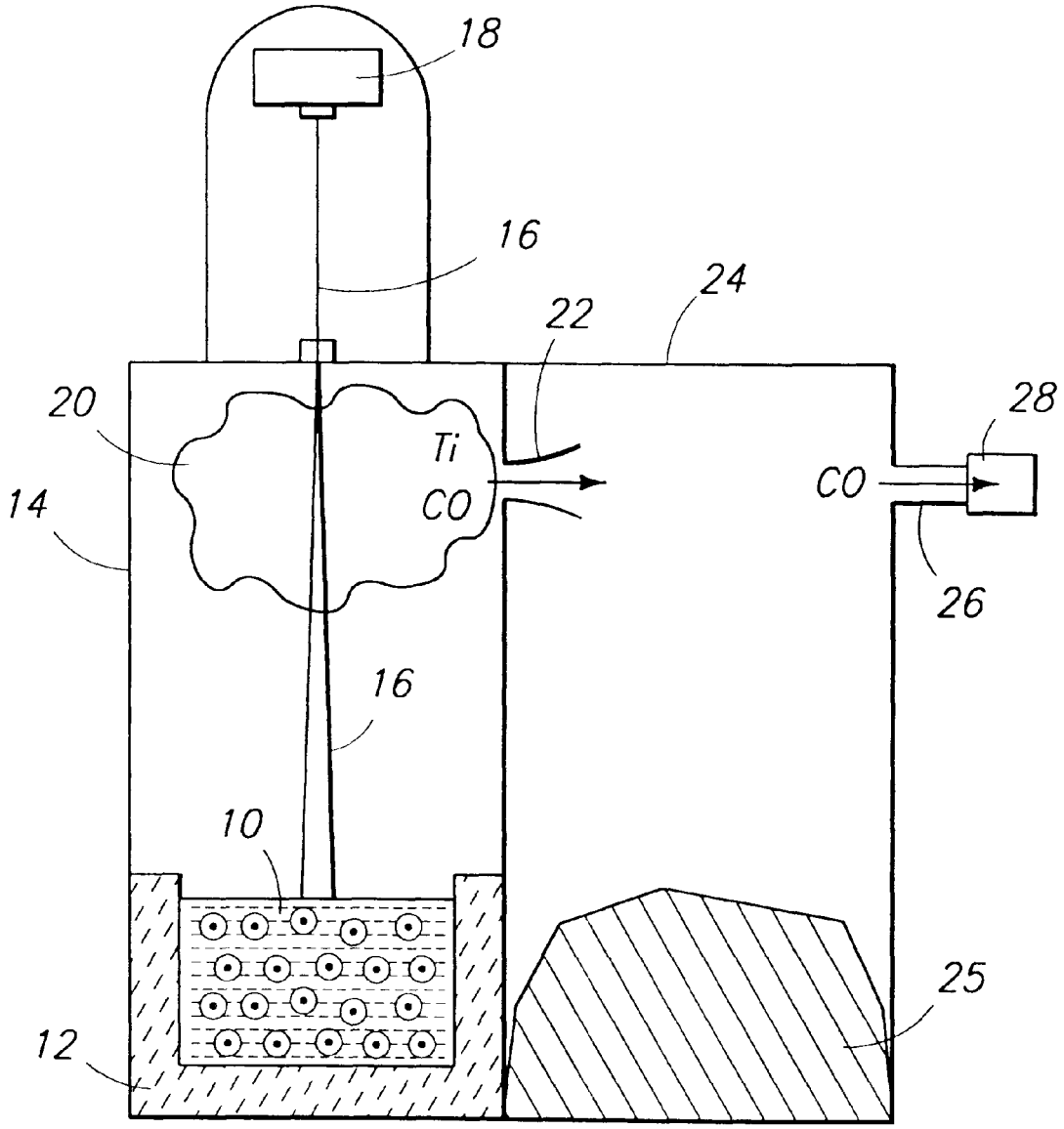
FIG. 1 is a schematic representation of one embodiment of the invented process in which titania is reduced with carbon.

FIG. 1 is a schematic representation of one embodiment of the invented process for producing titanium in which titania is reduced with carbon. The overall reduction reaction for the process of FIG. 1 is illustrated in Equation No. 1.

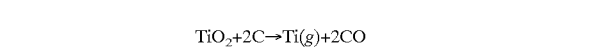

$$TiO_2+2C \rightarrow Ti(g)+2CO \quad (1)$$

Figure 5:
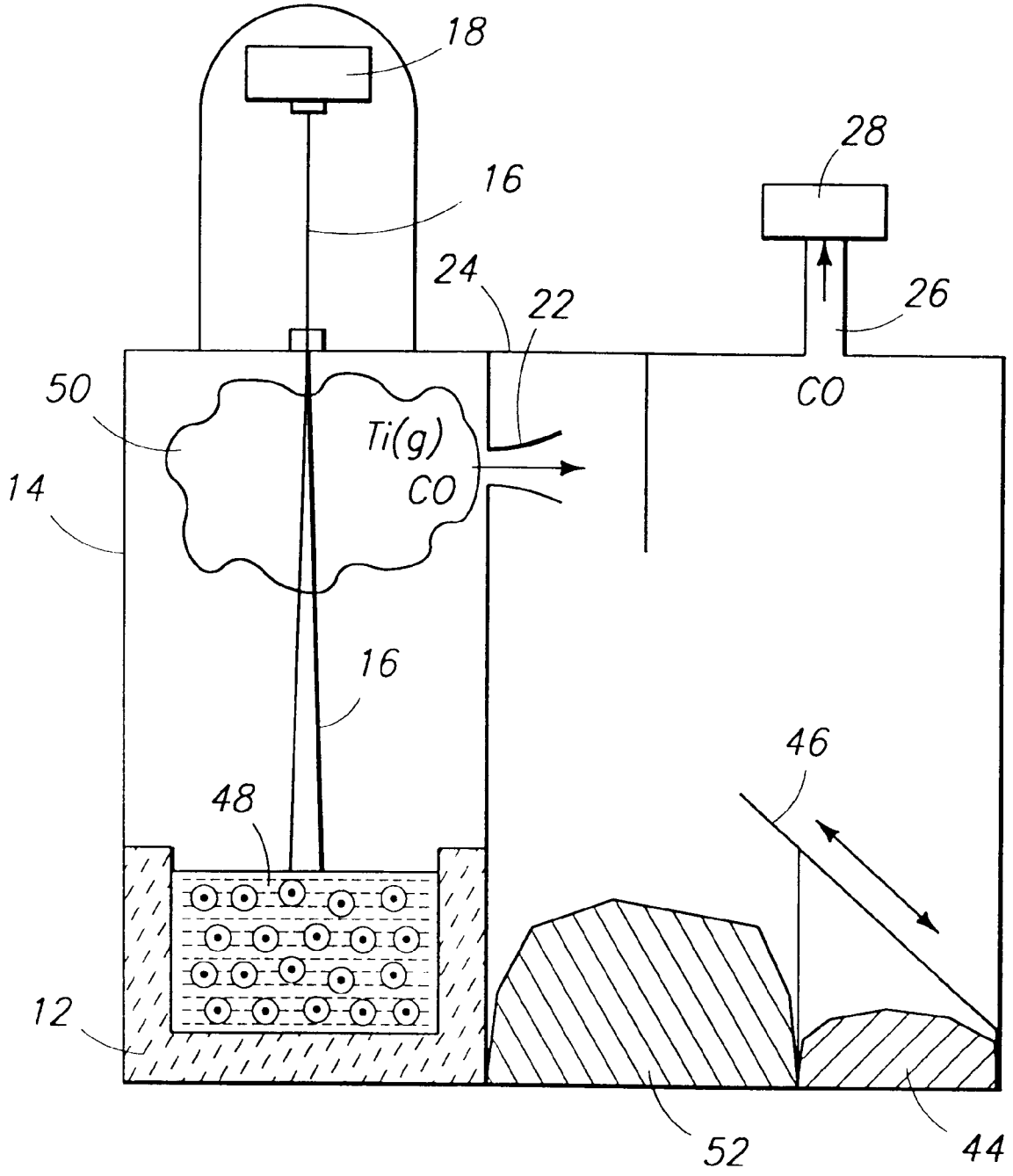
Figure 6:
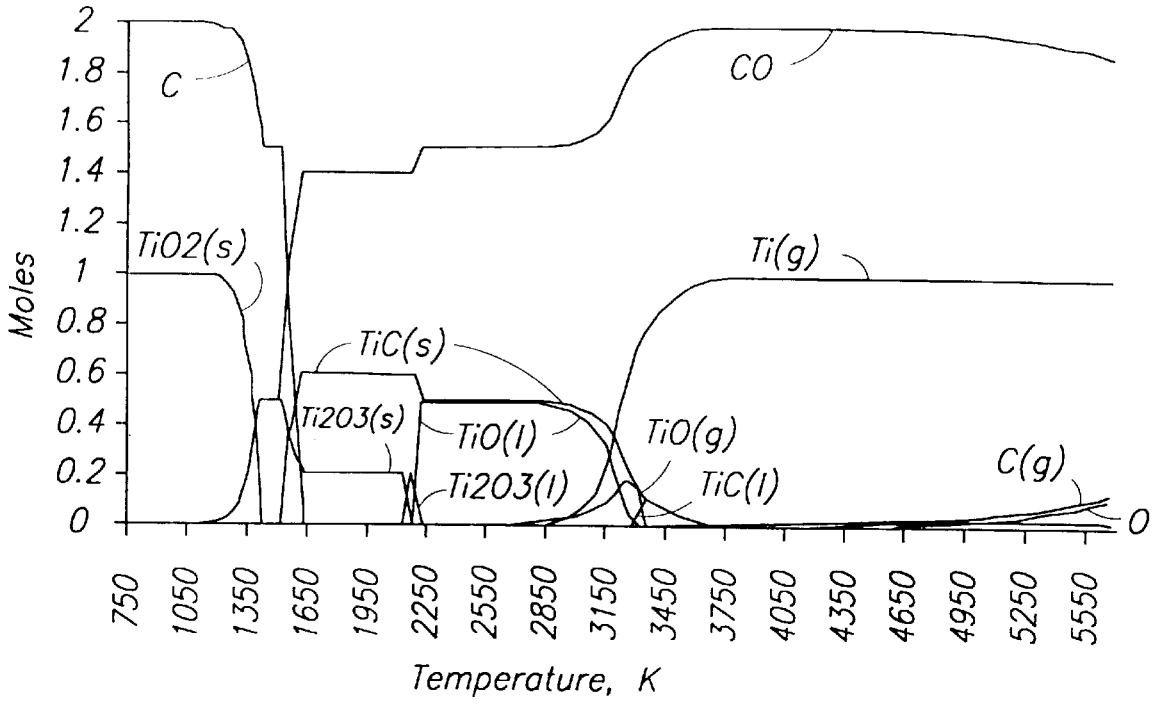
FIG. 6 is a graph of a thermodynamic analysis for the reduction of titania with carbon carried out at a pressure of one atmosphere.

FIG. 5 is a graph illustrating a thermodynamic analysis for the reduction reaction of Equation No. 1 carried out at a pressure of one atmosphere. FIG. 6 is a graph illustrating a thermodynamic analysis for the reduction reaction of Equation No. 1 carried out in a vacuum of $10^{-6}$ atmospheres.

Referring first to FIG. 1, a mixture 10 of titania and carbon is fed into or otherwise placed in a crucible 12 in an enclosed reaction chamber 14. The titania and carbon mixture 10 is exposed to the electron beam 16. The electron beam 16 is generated by an electron beam source 18. The electron beam 16 heats mixture 10 to induce the reaction of Equation No. 1 and produce titanium and carbon monoxide gases. The titanium/carbon monoxide gas atmosphere 20 is cooled rapidly as the gases expand through nozzle 22 into a lower pressure cooling chamber 24. Titanium condenses out of the titanium/carbon monoxide atmosphere 20 as it cools and collects at the bottom of cooling chamber 24 as a fine powder 25. The cooling of atmosphere 20 essentially prevents the back reaction to titania.

Figure 2:
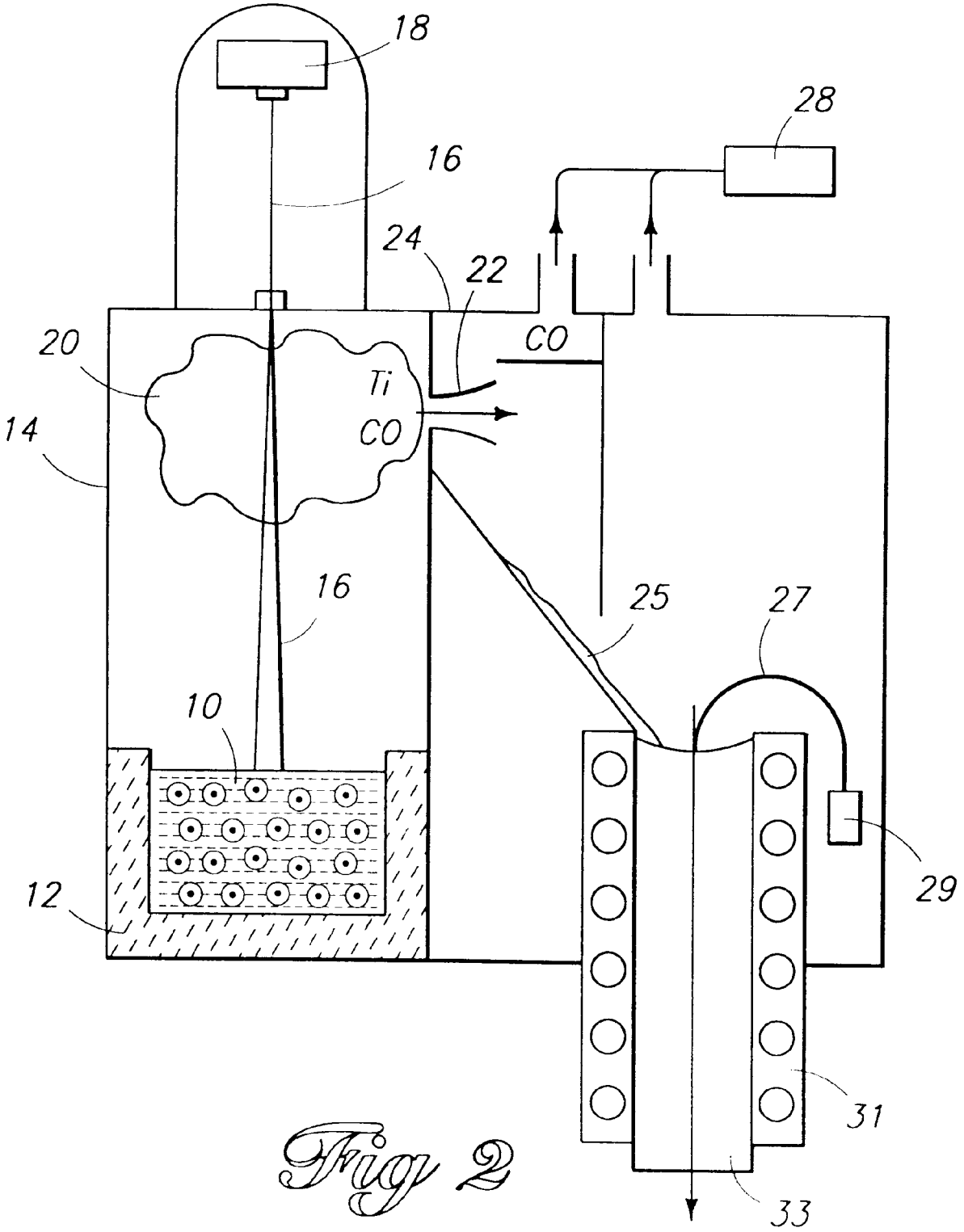
FIG. 2 is a schematic representation of another aspect of the process in which the titanium powder product of the reduction reaction is refined and melted into ingots.

Referring to FIG. 2, condensate 25, which in this case is a fine titanium powder, may be exposed to a second electron beam 27 generated by electron beam gun 29 at the bottom of cooling chamber 24. Electron beam 46 heats condensate 25 to about 2,000° K. to melt the titanium powder 25. The molten titanium can then be collected, for example, in a continuous casting mold 31 to form titanium ingots 33.

The carbon monoxide gas is evacuated through outlet 26 by vacuum pump 28. Vacuum pump 28 also controls the pressure in cooling chamber 24.

The reaction of the titania with the carbon occurs at a temperature between 3,600° K. and 4,600° K. when the reaction is carried out at a pressure of one atmosphere, as shown in FIG. 5. The reaction occurs at a temperature between 1,900° K. and 3,000° K. when the reaction is carried out under a vacuum of $10^{-6}$ atmospheres, as shown in FIG. 6. An electron beam output in the range of 10 kW to 10,000 kW would be adequate to generate the required reaction temperatures within mixture 10. The feed rate of the starting mixture can vary in the range of 3.1 kilograms to 3,100 kilograms per hour depending on the power of the electron beam.

The overall reaction, which is illustrated in Equation No. 1, is endothermic. The enthalpy of formation change for the reactants at 298° K. is approximately 1,180 kJ per mole. It is estimated that the process consumes about 6.8 kilowatt-hours per kilogram of titanium that is produced.

Reduction of Titania with Methane

Figure 3:
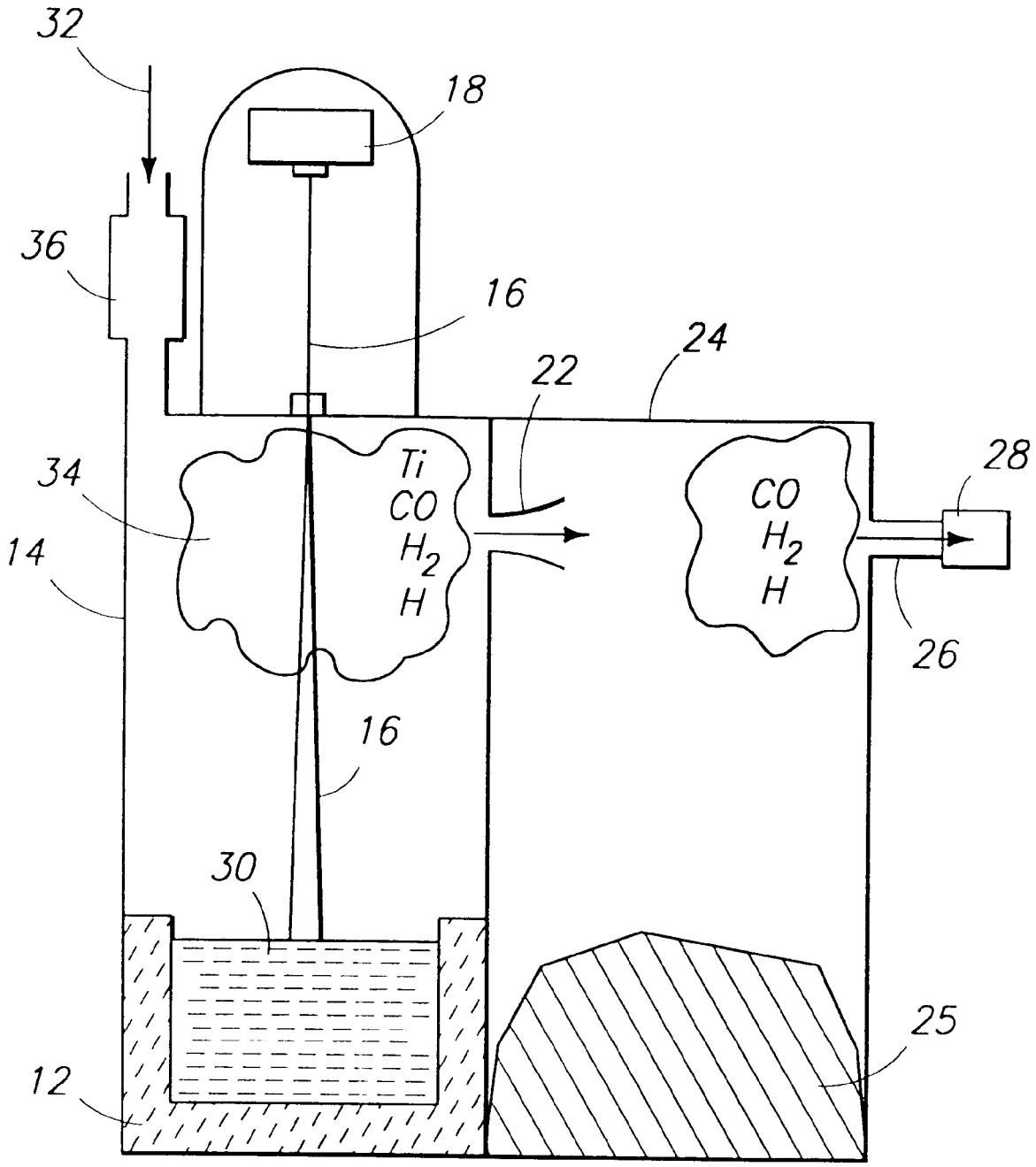
FIG. 3 is a schematic representation of a second embodiment of the process in which titania is reduced with methane gas.

FIG. 3 is a schematic representation of a second embodiment of the invented process in which titania is reduced with methane gas. The overall reduction reaction for the process of FIG. 3 is illustrated in Equation No. 2 when the reaction is carried out at a pressure of one atmosphere and in Equation No. 3 when the reaction is carried out under a vacuum of $10^{-6}$ atmospheres.

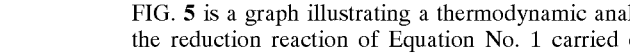

$$TiO_2+2CH_4 \rightarrow Ti(g)+2CO+(2.5-0.5)H_2+(3-7)H \quad (2)$$

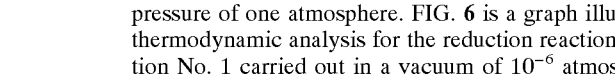

$$TiO_2+2CH_4 \rightarrow Ti(g)+2CO+(2-0)H_2+(4-8)H \quad (3)$$

Figure 7:
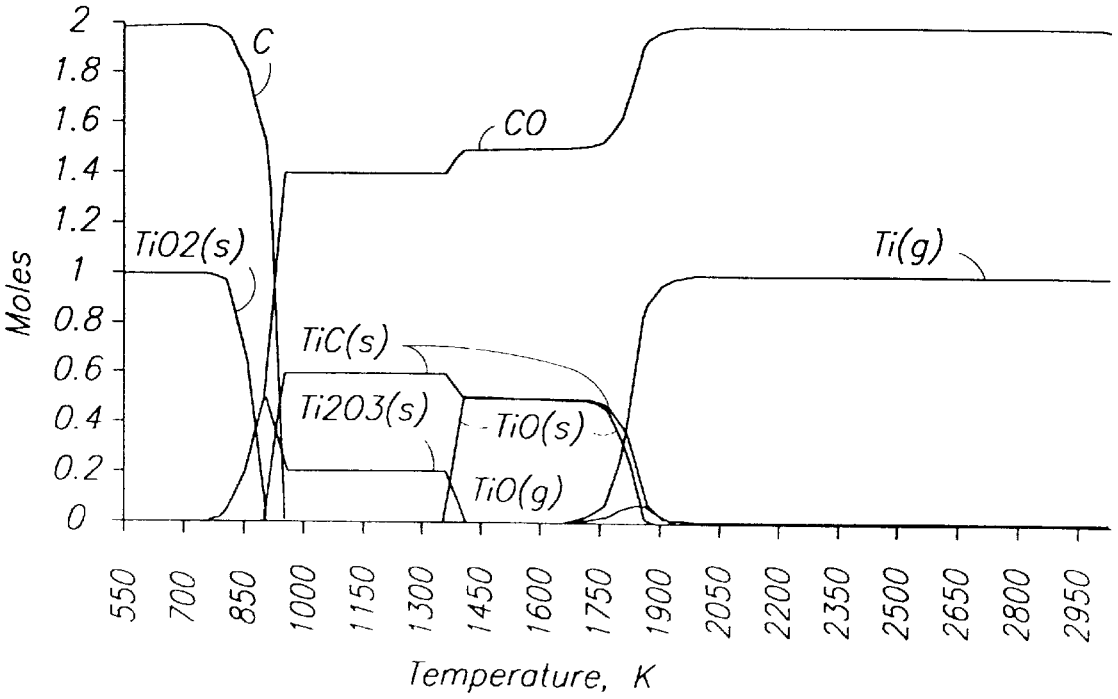
FIG. 7 is a graph of a thermodynamic analysis for the reduction of titania with carbon carried out in a vacuum of $10^{-6}$ atmospheres.
Figure 8:
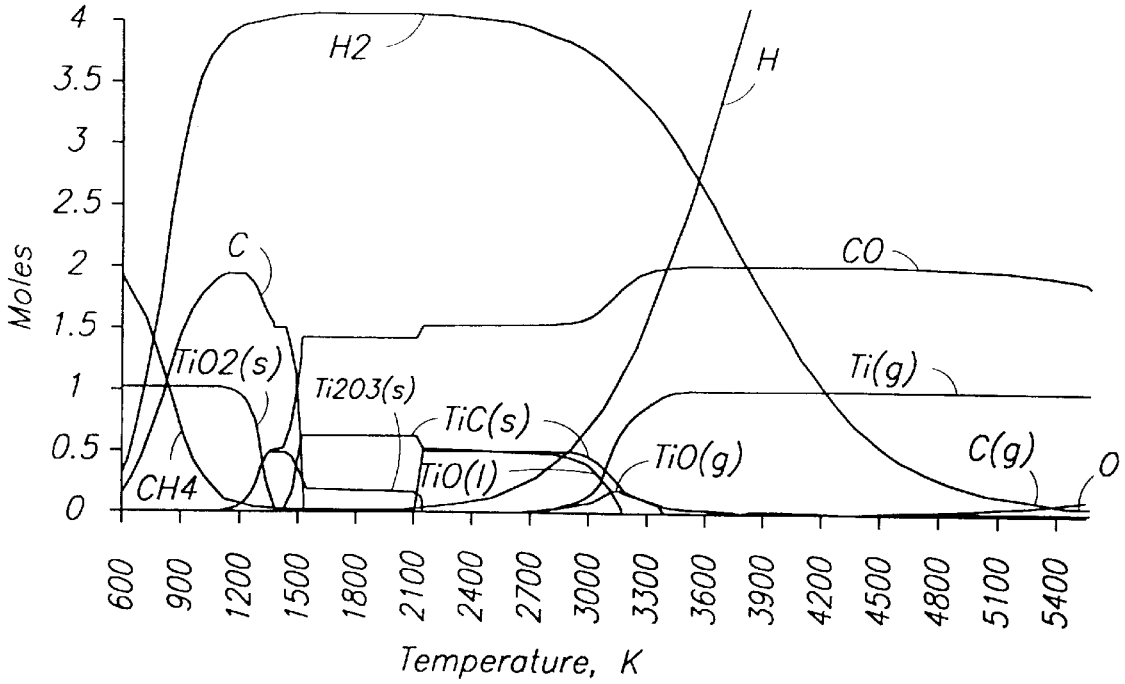
FIG. 8 is a graph of a thermodynamic analysis for the reduction of titania with methane carried out at a pressure of one atmosphere.

FIG. 7 is a graph illustrating a thermodynamic analysis for the reaction of Equation No. 2 (in which the reaction is carried out at a pressure of one atmosphere). FIG. 8 is a graph illustrating a thermodynamic analysis for the reaction of Equation No. 3 (in which the reaction is carried out in a vacuum of $10^{-6}$ atmospheres).

Referring to FIG. 3, titania starting material 30 is fed into or otherwise placed in reaction chamber 14. Methane gas 32 is introduced into reaction chamber 14 and the titania 30 and methane 32 are exposed to electron beam 16. Electron beam 16 vaporizes titania 30. The methane 32 reacts with the vaporized titania to produce titanium, carbon monoxide and hydrogen gases. The titanium/carbon monoxide-hydrogen atmosphere 34 is cooled rapidly as the gases expand through nozzle 22 into a lower pressure cooling chamber 24. Titanium condenses out of the titanium/carbon monoxide-hydrogen atmosphere 34 as it cools and collects at the bottom of cooling chamber 24 as, in this case, a fine powder 25. The carbon monoxide and hydrogen gases are evacuated through outlet 26 by vacuum pump 28.

The reaction occurs at a temperature between 3,500° K. and 4,300° K. when the reaction is carried out at a pressure of one atmosphere, as shown in FIG. 7. The reaction occurs at a temperature between 1,900° K. and 3,000° K. when the reaction is carried out under a vacuum of $10^{-6}$ atmospheres. It may be desirable, and in some cases necessary, to pre-heat methane 32 with a heater 36 to about 1,000° K. to ensure that the mixture of methane and evaporated titania products stays above the required reaction temperature. An electron beam output in the range of 10 kW to 10,000 kW directed at the center portion of titania 30 should be adequate to vaporize the titania. The feed rate of the starting mixture can vary in the range of 2.0 kilograms to 2,000 kilograms per hour depending on the power of the electron beam.

The overall reaction, which is illustrated in Equation Nos. 2 and 3, is endothermic. The enthalpy of formation change for the reactants at about 298° K is 1,962–3,043 kJ per mole. The actual enthalpy change depends on the distribution of atomic and molecular hydrogen that varies according to the processing temperatures. It is estimated that the process consumes about 11.4 kilowatt-hours per kilogram of titanium produced.

Removing Refractory Impurities

Titania based ore is often used as the starting raw material for the production of titanium. This ore can contain refractory impurities such as niobium and molybdenum. The reduction of titania based raw material that contains niobium and molybdenum is illustrated in Equation No. 4.

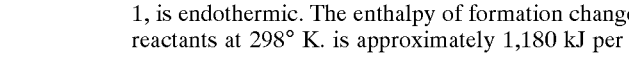

$$TiO_2+2C+Nb+Mo \rightarrow Ti(g)+2CO+Nb(s)+Mo(s) \quad (4)$$

Figure 9:
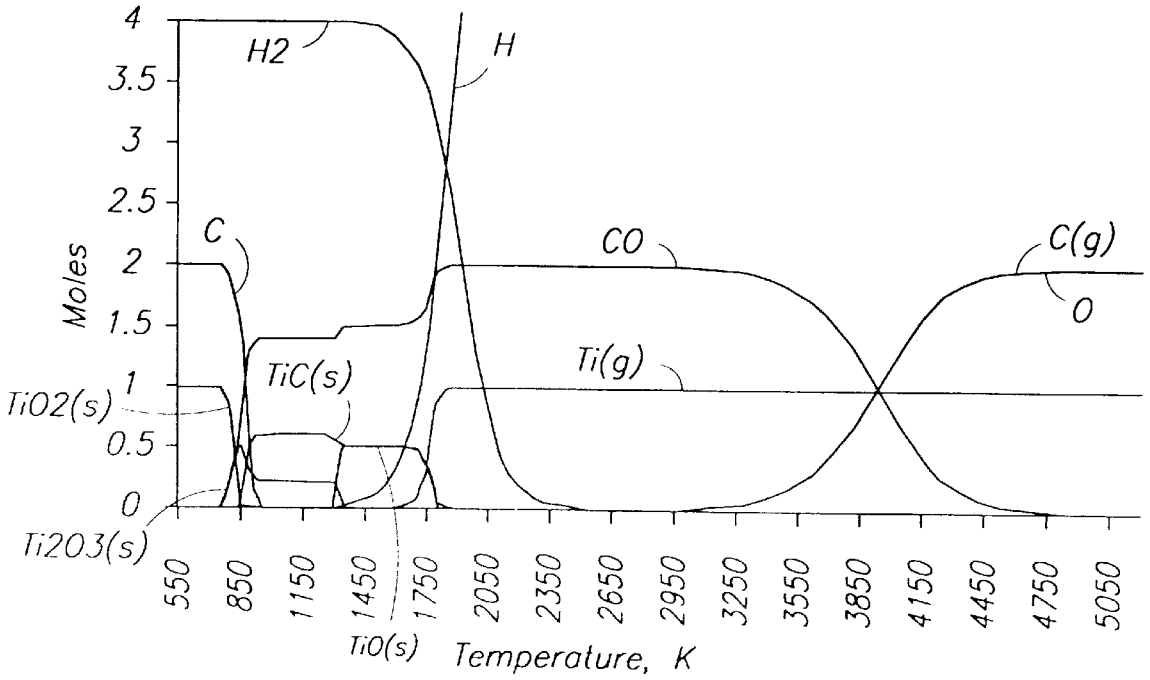
FIG. 9 is a graph of a thermodynamic analysis for the reduction of titania with methane carried out in a vacuum of $10^{-6}$ atmospheres.
Figure 10:
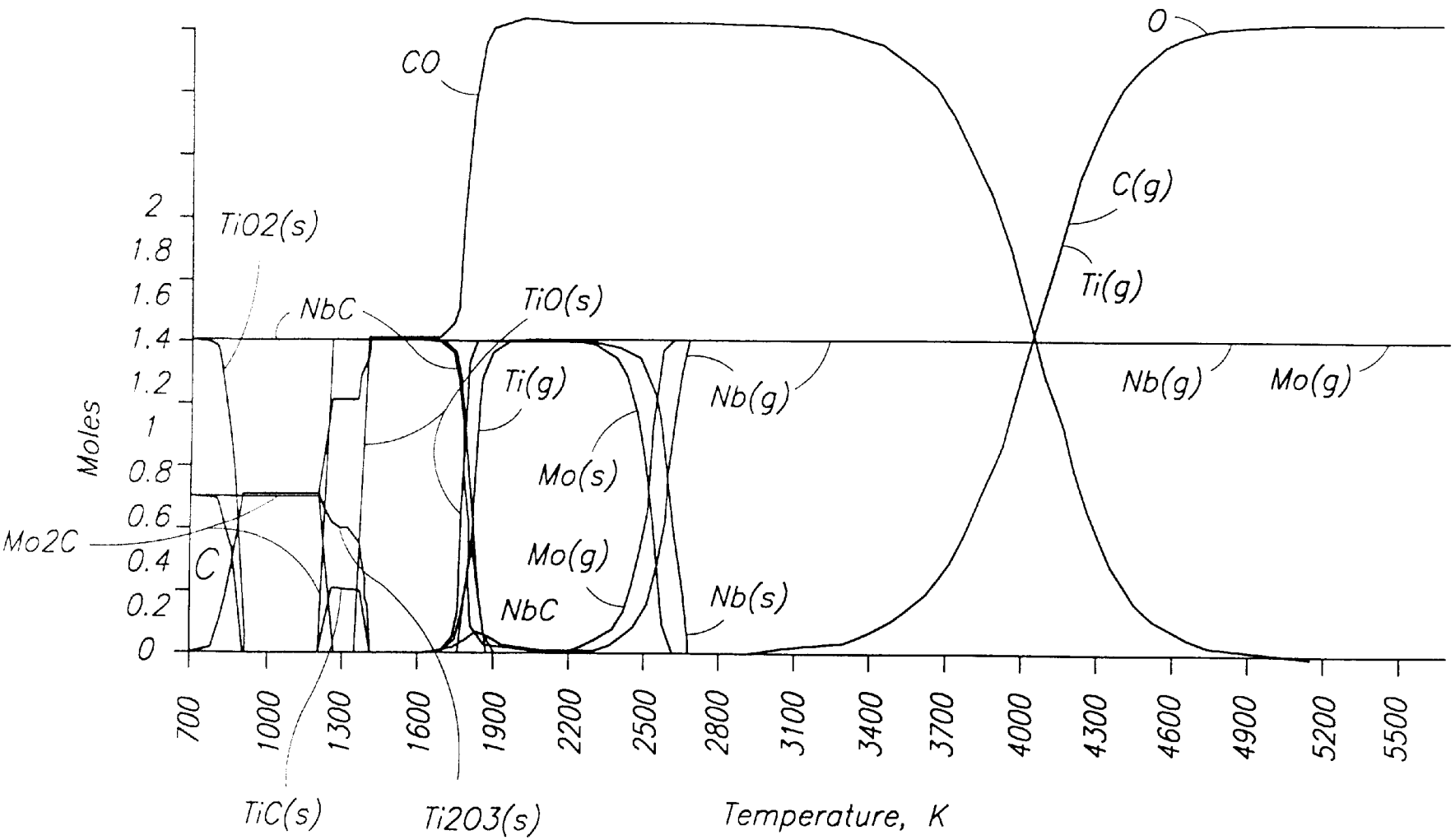
FIG. 10 is a graph of a thermodynamic analysis for the reduction of titania and the removal of niobium and molybdenum impurities carried out in a vacuum of $10^{-6}$ atmospheres.

The niobium and molybdenum remain in the solid state while the titanium reduction occurs and titanium gas is formed. FIG. 9 is a graph of a thermodynamic analysis for the reduction of titania that includes niobium and molybdenum impurities carried out in a vacuum of $10^{-6}$ atmospheres. FIG. 10 is a graph of a thermodynamic analysis illustrating the effect of the presence of niobium and molybdenum on the reduction of titania. As shown in FIGS. 9 and 10, the optimum temperature for the reaction is 2,000° K. to 2,300° K. In this temperature range, the titanium is completely vaporized while the evaporation of the niobium and molybdenum is negligible.

Figure 11:
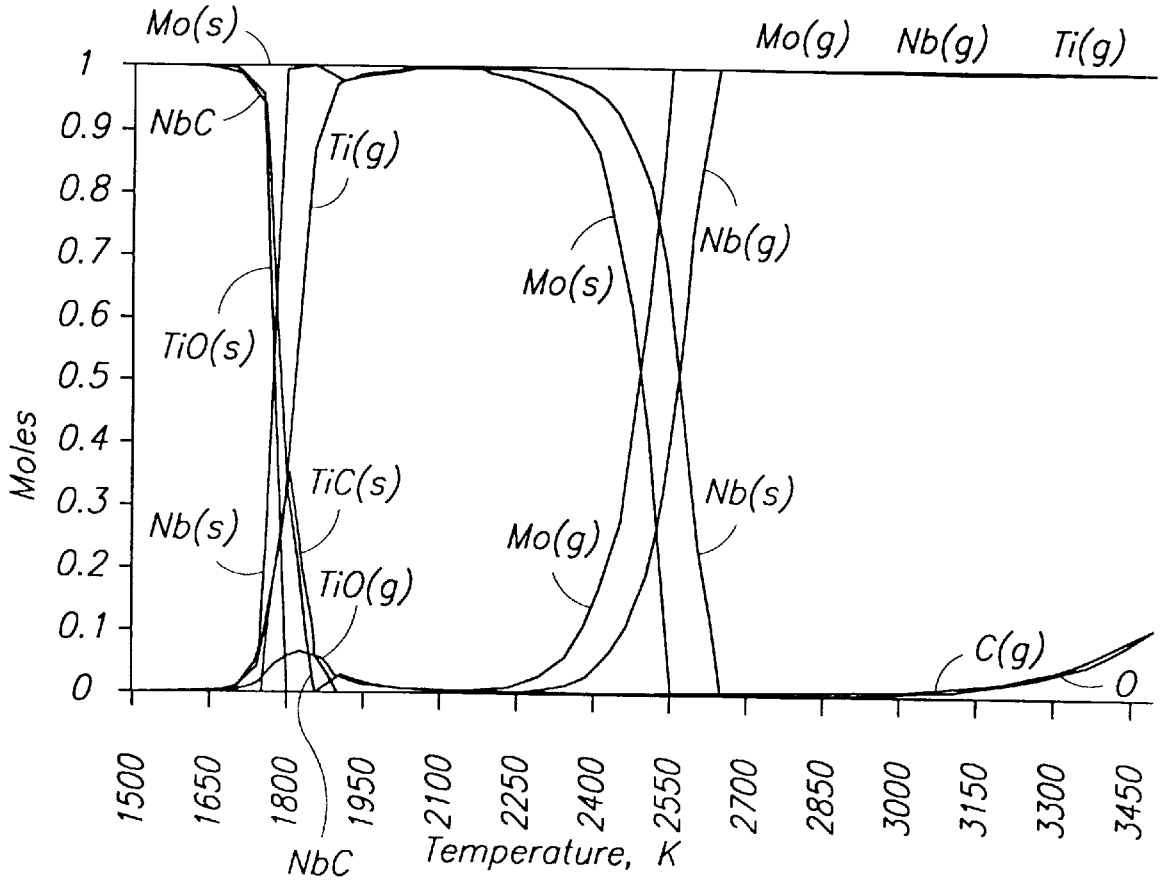
FIG. 11 is a graph of a thermodynamic analysis illustrating the effect of the presence of niobium and molybdenum on the reduction of titania.
Figure 12:
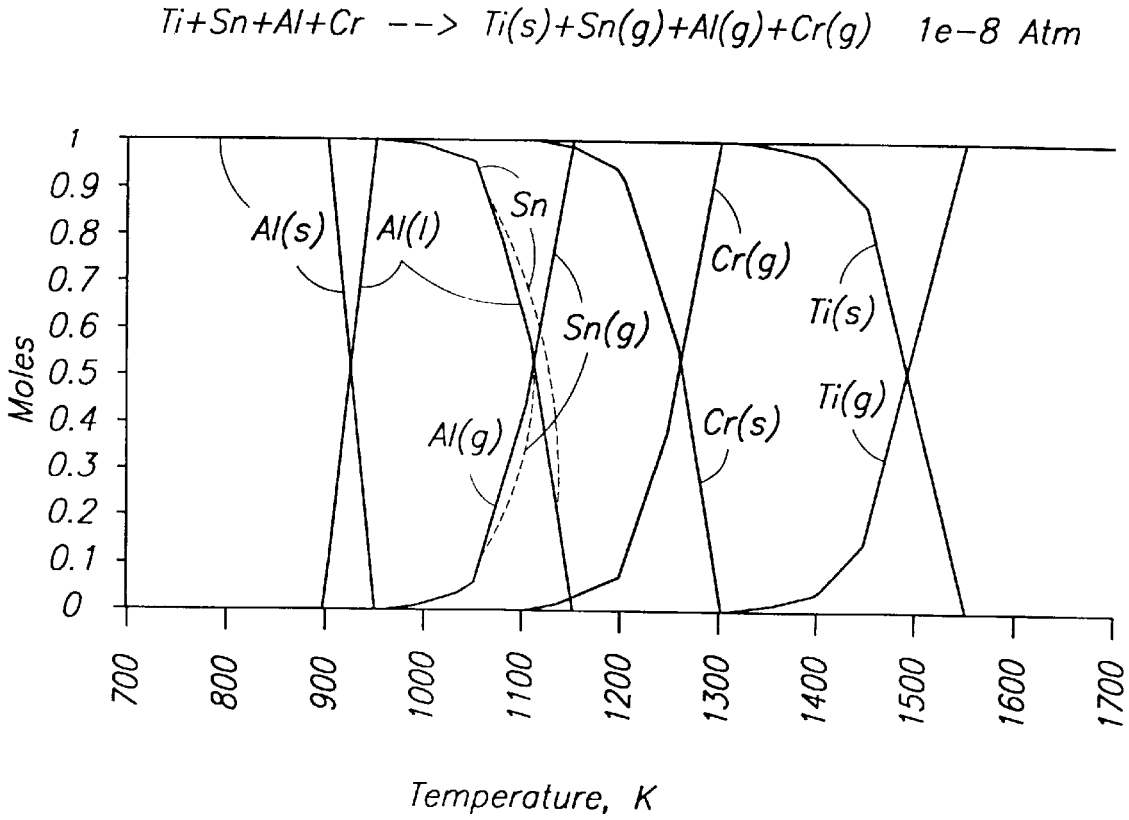
FIG. 12 is a graph of a thermodynamic analysis illustrating the effect of vacuum heat treating the titanium reaction product to remove tin, aluminum and chromium impurities.

The titanium powder reaction product 25 (in FIG. 1), which is shown in powder form, may be heat treated to remove more volatile impurities such as tin, aluminum and chromium. Referring to FIG. 11, heating titanium powder containing tin, aluminum and chromium to about 1,300° K. in a vacuum of $10^{-6}$ atmospheres will vaporize the impurities while leaving the titanium in the solid state.

Removal of Iron Oxides and Reduction of Ilmenite

Another raw material for titanium production is ilmenite ($TiO_2$*FeO) which can be contaminated with other iron oxides. Both of the processes described above for the reduction of titania may be used to reduce ilmenite, or any other titanium ore contaminated with iron and iron oxides, by adding carbon to remove the impurities. The overall reactions for the reduction of ilmenite are illustrated in Equations No. 6 and 7.

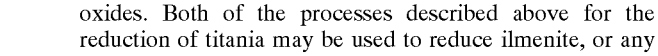

$$TiO_2{*}FeO+3C \rightarrow \tfrac{1}{2}TiO(s)+\tfrac{1}{2}TiC(s)+Fe(g)+2\tfrac{1}{2}CO \quad (6)$$

Figure 4:
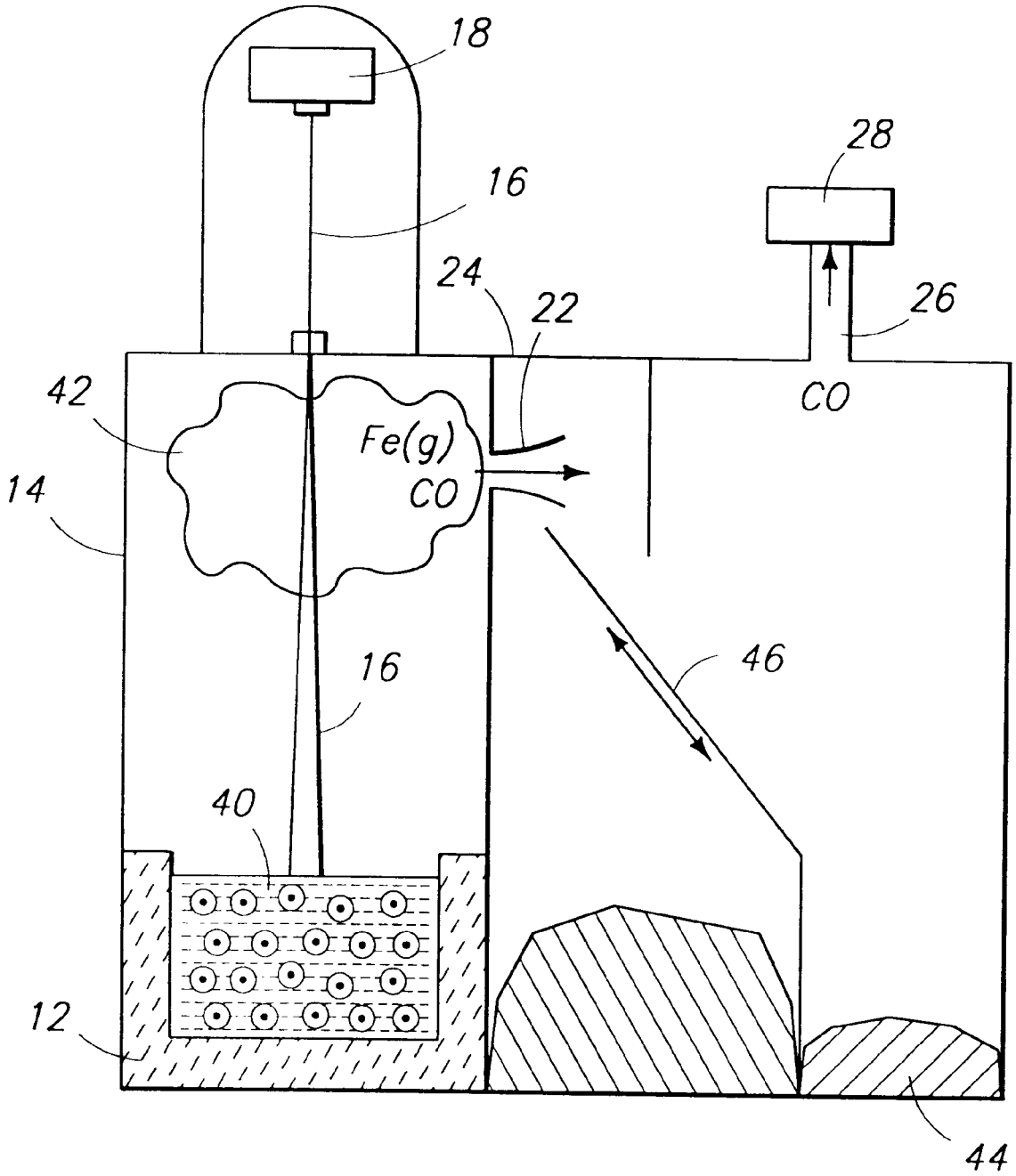
FIGS. 4 and 5 are schematic representations of a third embodiment of the invented process in which ilmenite ore is reduced with carbon.

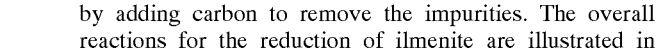

$$\tfrac{1}{2}TiO+\tfrac{1}{2}TiC \rightarrow Ti(g)+CO \quad (7)$$

referring to FIG. 4, a mixture 40 of ilmenite and carbon is fed into or otherwise placed in a crucible 12 in an enclosed reaction chamber 14. Mixture 40 is exposed to an electron beam 16 to heat the mixture and induce the reaction of Equation No. 6. The reaction produces solid titanium carbide, solid titanium monoxide and an atmosphere 42 of iron vapor and carbon monoxide. The iron/carbon monoxide atmosphere 42 is cooled as the gases expand through nozzle 22 into a lower pressure cooling chamber 24. Iron condenses out of the iron/carbon monoxide atmosphere as it cools and is directed to a separate collector 44 at the bottom of cooling chamber 24 by a movable barrier 46. Thus, this step removes iron or iron oxides from starting mixture 40.

As a next step, and referring to FIG. 5, the mixture 48 of solid titanium carbide and titanium monoxide left in crucible 12 is again exposed to electron beam 16 to heat the mixture and induce the reduction of Equation No. 7. The reaction produces an atmosphere 50 consisting of titanium vapor and carbon monoxide. Atmosphere 50 is cooled rapidly as the gases expand through nozzle 22 into a lower pressure cooling chamber 24. Titanium condenses out of atmosphere 50 as it cools and the condensate 52 collects at the bottom of cooling chamber 24. Carbon monoxide is evacuated through outlet 26 by vacuum pump 28.

The collected titanium can be produced in the form of ingots in a manner shown in FIG. 2.

The analysis shows that iron oxide is completely removed from the starting mixture of ilmenite and carbon heated to 2,850° K. under a pressure of one atmosphere or 1,550° K. under a vacuum of $10^{-6}$ atmospheres. Under these conditions, the carbon reduces iron oxide contained in the initial ilmenite to gaseous iron and carbon monoxide is formed. These gases (FeO and CO) vaporize from the mixture. Thus, the composition of the starting mixture of ilmenite and carbon is changed because of the removal of the iron monoxide. The new composition of the mixture now consists of titanium carbide and titanium monoxide and contains neither iron nor iron compounds. This mixture is then ready for the subsequent direct reduction.

The purification of ilmenite according to Equation No. 6 occurs at a temperature between 2,800° K. and 3,000° K. when the reaction is carried out at a pressure of one atmosphere. The purification takes place at a temperature between 1,550° K. and 1,850° K. when the reaction is carried out under a vacuum of $10^{-6}$ atmospheres. The reduction of the titanium carbon and titanium monoxide according to Equation No. 7 occurs at a temperature between 3,600° K. and 4,600° K. when the reaction is carried out at a pressure of one atmosphere (the same as shown in FIG. 6). The reaction occurs at a temperature between 1,900° K. and 3,000° K. when the reaction is carried out under a vacuum of $10^{-6}$ atmospheres (the same as shown in FIG. 7). An electron beam output in the range of 10 kW to 10,000 kW should be adequate to generate the required reaction temperatures within the mixture in crucible 12. The feed rate of the starting mixture can vary in the range of 1.2 kilograms to 1,200 kilograms per hour depending on the power of the electron beam. The process, which is illustrated in Equations No. 6 and 7, is endothermic. The enthalpy of formation change for the reactants at 298 K is approximately 1,404 kJ per mole. It is estimated that the process consumes about 8.1 kilowatt-hours per kilogram of titanium that is produced.

The invention has been shown and described with reference to the foregoing exemplary embodiments of the invented process for the production of titanium from titania and titania based starting materials. It is expected, however, that the process may also be applied to various other titanium containing raw materials or manufactured titanium compounds. In addition, the titanium need not be condensed out as a powder using the adiabatic (rapid) expansion method described above. The titanium may be collected as a liquid by maintaining the walls of the cooling chamber at about 1,953° K., the melting point of titanium. Under this condition, the titanium particles cooled will be melted to a liquid and flow down the walls. The titanium might also be condensed out as a liquid by maintaining the pressure in the cooling chamber low enough to condense the titanium but high enough to keep the temperature above the melting point of titanium.

Alternatively, the titanium may be collected as a solid metal in the reaction chamber by installing a cooled plate, sometimes called a "cold finger", in the space above the raw materials. The titanium will be condensed out on the plate as a solid metal. It is also possible using gas cooling, rather than water cooling, to maintain the cooling plate at the titanium melting point to condense out the titanium as a liquid directly in the reaction chamber.

It will be understood, therefore, that the various embodiments of the invention shown and described may be modified or changed without departing from the scope of the invention, which is set forth in the following claims.

What is claimed is:

1. A process for producing titanium, comprising vaporizing titania in the presence of carbon to form gaseous titanium and cooling the gaseous titanium to form solid titanium.

2. A process for producing titanium, comprising vaporizing titania in the presence of carbon to form gaseous titanium, transforming the gaseous titanium into solid titanium, melting the solid titanium and molding the molten titanium into ingots.

3. A process according to claim 1, wherein the step of cooling comprises rapidly expand ing the gaseous titanium.

4. A process for producing titanium, comprising vaporizing a mixture of titania and carbon and cooling the vapor.

5. A process according to claim 4, wherein the step of cooling comprises rapidly expanding the vapor.

6. A process for producing titanium, comprising vaporizing titania in the presence of methane gas preheated to about 1,000° K.

7. A process for producing titanium, comprising vaporizing titania in the presence of methane gas by heating the titania to a temperature in the range of 1,900° K. to 4,600° K. at a pressure in the range of 1 atmosphere to $10^{-6}$ atmospheres.

8. A process for producing titanium, comprising vaporizing titania in the presence of methane gas by heating the titania to a temperature in the range of 1,900° K. to 3,000° K. under a vacuum of about $10^{-6}$ atmospheres.

9. A process for producing titanium, comprising vaporizing titania in the presence of methane gas by heating the titania to a temperature in the range of 3,000° K. to 4,600° K. at a pressure of about one atmosphere.

10. A process for producing titanium, comprising vaporizing titania in the presence of methane gas and cooling the vapor.

11. A process according to claim 10, wherein the step of cooling comprises rapidly expanding the vapor.

12. A process for producing titanium, comprising:

mixing titania and carbon;

heating the mixture under conditions sufficient to form titanium gas;

condensing out solid titanium;

melting the solid titanium; and molding the molten titanium into ingots.

13. A process for producing titanium, comprising:

exposing a titanium containing material to an electron beam in the presence of carbon;

vaporizing the titanium to form gaseous titanium; and cooling the gaseous titanium to form solid titanium.

14. A process for producing titanium, comprising:

placing a titanium containing material in a reaction chamber;

introducing methane gas into the reaction chamber;

forming an atmosphere containing titanium and carbon monoxide gases; and cooling the atmosphere.

15. The process according to claim 14, wherein the step of forming an atmosphere includes exposing the titanium containing material to an electron beam.

16. The process according to claim 15, wherein the atmosphere is formed in the reaction chamber and the step of cooling includes rapidly expanding the atmosphere into a lower pressure cooling chamber.

17. A process for producing titanium, comprising:

exposing a titanium containing material to an electron beam in the presence of carbon;

vaporizing the titanium and one or more impurities in the titanium containing material to form an atmosphere of titanium gas and impurity gases;

condensing out a mixture of titanium and one or more impurities from the atmosphere; and boiling off the impurities from the mixture.

18. The process according to claim 17, wherein the step of boiling off the impurities comprises heating the mixture up to about 1,300° K. under a vacuum of about $10^{-8}$ atmospheres.

19. A process for producing titanium, comprising:

exposing a titanium containing material contaminated with iron or iron compound impurities to an electron beam in the presence of carbon;

vaporizing the iron impurities to form a solid titanium carbide and titanium monoxide composition and an atmosphere of iron gases;

condensing out the iron impurities from the atmosphere;

vaporizing the titanium to form an atmosphere of titanium and carbon monoxide gases;

condensing out titanium; and collecting the titanium.

20. The process according to claim 19, wherein the titanium containing material is ilmenite and the impurity is iron or iron oxides.

21. The process according to claim 19, wherein the step of collecting the titanium includes forming molten titanium and further comprising the step of molding the molten titanium into ingots.

22. The process according to claim 21, wherein the step of collecting the titanium comprises cooling the titanium vapor to a temperature in the range of 1,800° K.–2,700° K.

* * * * *